United States Patent [19]

Clifft

[11] 4,233,788

[45] Nov. 18, 1980

[54] TOOL FOR BLOWING INSULATION INTO AN EXISTING WALL STRUCTURE HAVING A BRICK EXTERIOR

[75] Inventor: Dale L. Clifft, Tarzana, Calif.

[73] Assignee: LCG, Inc., Indio, Calif.

[21] Appl. No.: 51,613

[22] Filed: Jun. 25, 1979

[51] Int. Cl.[3] ..... E04G 21/00

[52] U.S. Cl. ..... 52/127; 52/743; 52/749

[58] Field of Search ..... 52/127, 173, 743, 749; 141/329; 428/71, 314

[56] References Cited

U.S. PATENT DOCUMENTS

| | | | |
|---|---|---|---|
| 2,592,081 | 4/1952 | Toulmin | 156/79 |
| 2,788,552 | 4/1957 | Miles | 52/127 |
| 2,863,797 | 12/1958 | Meyer | 428/425 |
| 3,007,208 | 11/1961 | Urban | 428/425 |
| 3,151,427 | 10/1964 | Meissner | 156/79 |
| 3,194,853 | 7/1965 | Weise | 52/127 |
| 3,560,285 | 2/1971 | Schroter | 156/77 |
| 3,785,913 | 1/1974 | Hallamore | 428/71 |
| 3,957,048 | 5/1976 | Jacobs | 128/214 R |
| 4,002,002 | 1/1977 | Barnhardt | 52/743 |
| 4,103,464 | 8/1978 | Clifft | 52/749 |

*Primary Examiner*—James A. Leppink
*Assistant Examiner*—Henry E. Raduazo
*Attorney, Agent, or Firm*—Jack C. Munro

[57] ABSTRACT

The apparatus and method of supplying pulverized insulative material within an existing wall structure which already has a pad of insulative material located within the wall. An access opening or hole is provided through the exterior wall surface. The tool includes a straight elongated tubular member which has a helical groove adjacent the outer end of the tool, the helical groove terminating in a cutting edge. The cutting edge portion of the tool is inserted through the access opening and rotated against the pad of insulation thereby cutting such until the cutting edge of the tool is located directly adjacent the backing layer of material of the pad of insulation. At this time, the tool is then rotated approximately 360 degrees causing the tool to penetrate the backing layer of material and locating the backing layer of material within the helical groove. By pulling outward slightly the backing layer is spaced from the inner wall. The backing layer is then punctured with a separate instrument. At this time insulation may be blown by air pressure through the tool to be deposited within the interior opening of the wall structure.

5 Claims, 6 Drawing Figures

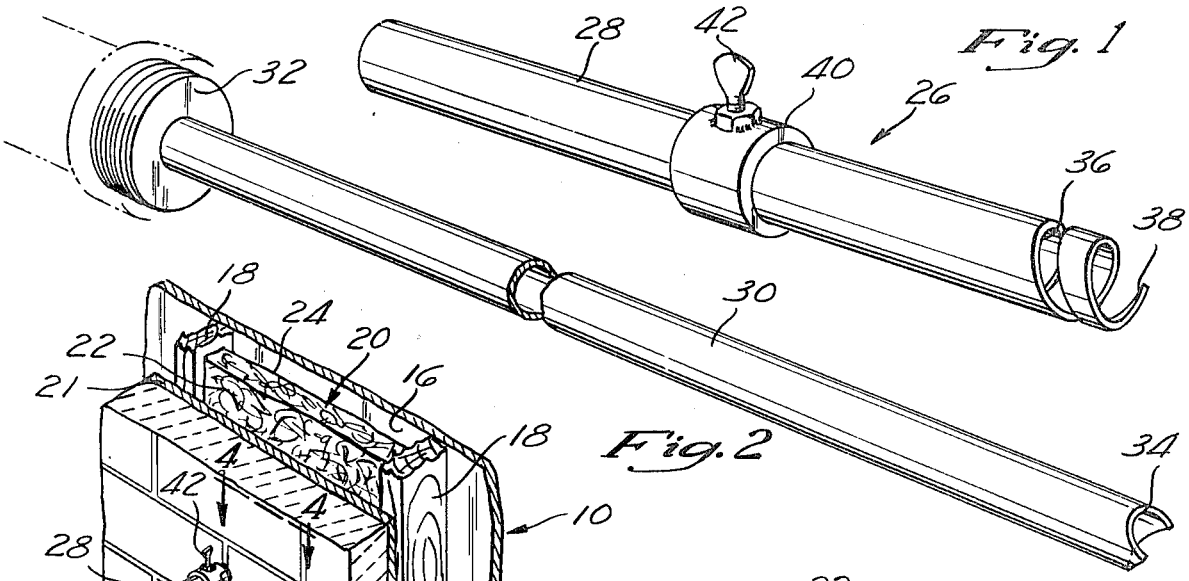
Fig. 1
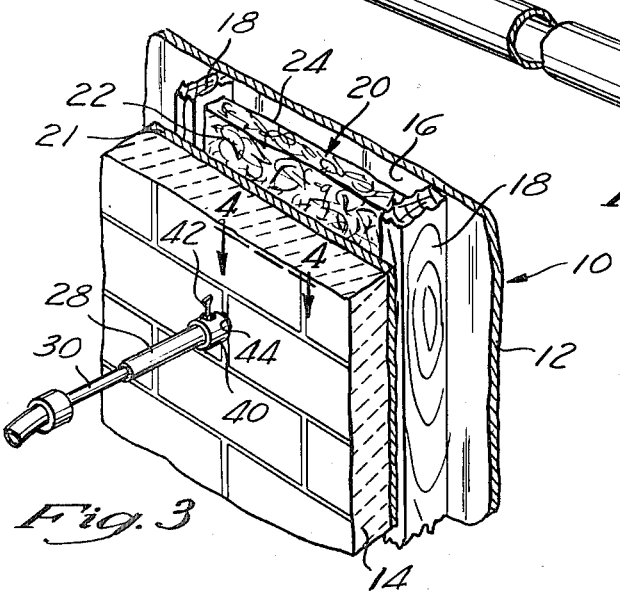
Fig. 2
Fig. 3
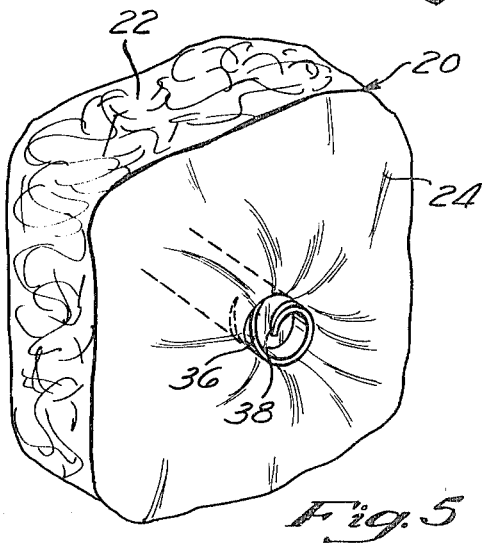
Fig. 5
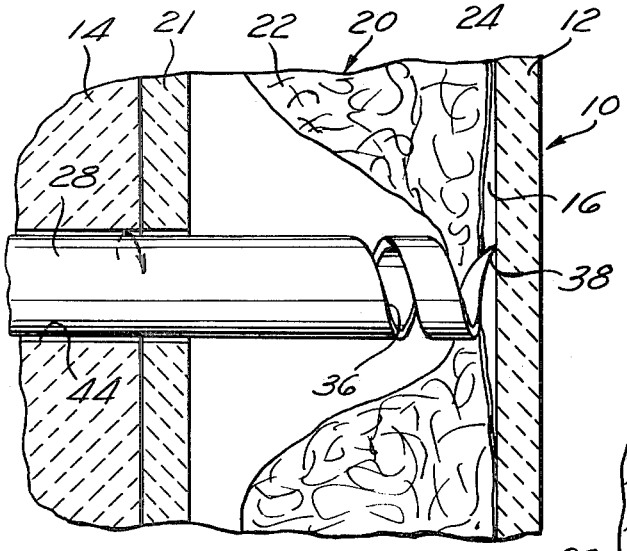
Fig. 4
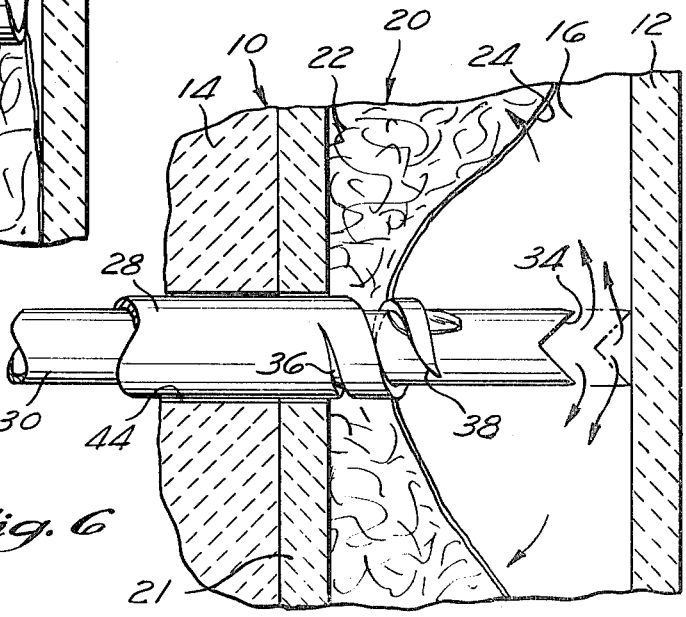
Fig. 6

TOOL FOR BLOWING INSULATION INTO AN EXISTING WALL STRUCTURE HAVING A BRICK EXTERIOR

BACKGROUND OF THE INVENTION

The subject matter of this invention is basically similar to the structure which is defined in U.S. Pat. No. 4,103,464, issued Aug. 1, 1978, by the present inventor and a Melvin G. Green.

The current construction technique of houses and buildings requires the placing of insulation within the exterior walls of the structure. The most economical way of accomplishing this is to employ a pad of fiberglass insulation material, usually three to four inches thick. On one side of the fiberglass there is located a backing strip which is usually of paper. This backing strip provides sufficient strength to the overall structure to facilitate installation and location within the opening between the studs and between the inner and outer wall surfaces of the wall.

Usually the amount and quality of insulation installed in the wall is what is minimally required. After the structure is built and occupied, at some later date, the owenrs of the property may desire to place further insulation within the walls.

The normal procedure previously was to cut a plurality of access openings through the exterior wall surface which connect with the interior openings or chambers within the wall with there being at least two in number of such chambers between each pair of studs. A tubular member of conduit would then be inserted through the access opening and in direct contact with the fiberglass insulation pad. Pulverized insulation would then be blown through the conduit into the wall chamber. However, because of the inherent "flimsiness" of the fiberglass insulation pad, the blown insulation would tend to quickly pack around the access opening. As a result, only a small amount of insulation could be blown into the wall chamber.

This problem is particularly compounded when the exterior wall surface is formed substantially thick. The aforementioned patent was directed to a structure which was designed to operate with a thin exterior wall surface such as a stucco wall surface. However, the tool defined and claimed in the aforementioned patent could not be used with a thick exterior wall surface such as a brick wall surface.

It would have been more desirable to conduct the insulation into the wall chamber through the inner surface of the wall. However, this would require a substantial number of access openings to be formed through the interior walls of the building or house. This is just not feasible as the holes would require substantial remodeling within the interior of the structure and damage to the interior furnishings could result due to the presence of workmen and equipment. The reason it was so desirable to place the insulation from the inside was that the tool could come into contact with the backing layer of material which would supply sufficient rigidity. As the insulation is blown into the wall chamber, the backing layer of material with the aid of air pressure, will merely push against the fiberglass, thereby forming an enlarged area for the blown insulation to be received.

SUMMARY OF THE INVENTION

The structure and method of this invention is believed to be summarily described in the Abstract of the Disclosure and reference is to be had thereto.

The primary objective of this invention is to provide a tool to supply additional pulverized insulation through an exterior wall being formed substantially thick such as being constructed of brick.

A further objective of this invention is that the blown insulation will be uniformly received through the entire wall chamber though it is only supplied through a single access opening into that chamber.

A further objective of this invention is that the tool of this invention is constructed of few parts and can be readily manufactured inexpensively.

BRIEF DESCRIPTION OF THE DRAWING

FIG. 1 is an isometric view of an elongated tubular member which is to be placed through an access opening formed within the exterior wall structure of the building or house and through which is to be supplied the pulverized insulation;

FIG. 2, is an isometric view of an elongated nozzle which is to be telescopingly received through the elongated tubular member of FIG. 1 which is to directly conduct the pulverized insulation into the interior chamber of the wall;

FIG. 3 is an isometric view of a portion of an existing wall structure showing the tool of this invention in use;

FIG. 4 is a cross-sectional view taken through line 4—4 of FIG. 3 depicting the locating of the elongated tubular member in conjunction with the pad of insulation material which pre-exists within a interior chamber of the wall;

FIG. 5 is a diagramatic isometric view of the end of the elongated tubular member showing its connection to the backing strip of material of the insulation pad; and FIG. 6 is a cross-sectional view similar to FIG. 4 but showing the backing strip of the insulation pad being spaced from the inner wall of the building wall structure.

DETAILED DESCRIPTION OF THE SHOWN EMBODIMENT

Referring particularly to the drawing, there is shown a segmental view of an exterior wall structure 10 of a building or house. The wall structure 10 is deemed to be conventional and is to comprise an inner wall 12 and an outer wall 14. The wall 12 will normally be of a plaster, paneling or dry wall construction. The outer wall 14 is to be constructed of a solid thick material such as brick. However, the outer wall 14 could be constructed of any type of exterior wall construction. It is to be understood that the structure of this invention is designed to be employed with an outer wall 14 that is formed several inches in thickness. However, it is also to be understood that the structure of this invention could be employed in conjunction with a thin outer wall 14.

Inside the outer wall 14 is a second wall 21 which is essentially identical to wall 12. The inner wall 12 is separated from the outer wall 14 by an interior chamber 16. The chamber 16 is divided into a plurality of separate chambers 16 due to the location of the vertical studs 18.

Located within the chamber 16 is a pad 20 of insulation material. The pad 20 of insulation material is composed of a thickness of one to six inches of fiberglass 22 to which has been secured on one side thereof a backing layer of material 24. The backing layer of material 24 will normally be of paper and although it is not shown, the sides of the paper of the backing layer 24 extend beyond the sides of the fiberglass insulation 22. It is these edges that facilitate attachment by staples or other types of conventional fastening means to the vertical studs 18 thereby locating at a proper position within the chamber 16 of the pad 20 of insulation material. The pad 20 of insulation material will be located within each and every wall chamber 16 of the exterior surface of the exterior wall 10.

The tool 26 of this invention takes the form of an elongated tubular member 28 and an elongated nozzle 30. The elongated tubular member 28 has an internal opening through which is to be telescopingly conducted in a close fitting manner the elongated nozzle 30. The elongated nozzle 30 is also hollow and is adapted to conduct pulverized insulation therethrough. The inner end of the nozzle 30 will normally be integrally attached to a threaded fitting 32 which is to facilitate connection to an insulation blowing machine (not shown). The outer end of the elongated nozzle 30 includes a sharpened edge 34. It is to be understood that nozzle 30 may be removed after puncturing of the paper backing 24 and the insulation blowing machine connected directly to nozzle 30 when higher volume insulation flow is desired.

The elongated tubular member 28 includes a helical groove 36. It is to be noted that the helical groove 36 extends slightly greater than 360 degrees through the wall thickness of the tubular member 28. The free end of the helical groove 36 terminates in a cutting edge 38.

Slidingly mounted on the elongated tubular member 28 is a collar 40. The collar 40 is to be slidingly movable along the entire length of the tubular member 28. The collar 40 includes a lock screw 42. The lock screw 42 when tightened binds against the elongated tubular member 28 to fixedly position the collar 40 with respect to the tubular member 28.

In the operation of the tool 26 of this invention, a plurality of access openings 44 are located within the outer wall 14. The size of each access opening 44 is to just accommodate the diameter of the elongated tubular member 28 with allowance for air pressure bleed. The operator places the tubular member 28 within an access opening 44 to the position shown substantially within FIG. 4 of the drawing. The tubular member 28 first contacts the pad 22 of fiberglass and compresses the fiberglass 22 and backing layer 24 against the inner wall 12. The operator then, with gentle inward pressure, begins twisting the tubular member 28 until a rotational binding action is perceived. This first binding action indicates that the cutting edge 38 is out through the backing layer 24 and is starting into the solid inner wall surface 12.

The operator then releases the inward pressure and proceeds to continue to rotate the tubular member 28. The cutting edge 38 is then worked free of the solid wall 12 and then the tubular member 28 is continued to rotate for approximately one turn or 360 degrees. At this particular point, the operator will then perceive a gentle rotational binding as the backing paper 24 bottoms out in the helical groove 36. The operator then pulls outwardly on the member 28 until it is felt that the pad 22 is sufficiently compressed. This position is shown within FIG. 6 of the drawing. The operator then moves the collar 40 into contact with the exterior of the wall surface 14 and the locking bolt 42 is tightened thereby fixedly securing the collar 40 to the elongated tubular member 28. The operator can then physically let go of the tubular member 28 and it will remain in place.

The nozzle 30 is then to be inserted through the tubular member 28 which causes the cutting edge 34 to penetrate and fold the portion of the backing strip 24 which is located within the tubular member 28. Continued inward movement of the nozzle 30 is completed until the threaded fitting 32 bottoms against the outer end of tubular member 28. The operator then backs up the nozzle 30 a short distance such as is shown in FIG. 6 of the drawing and then pulverized insulation is to be blown through the nozzle 30 and deposited in the interior chamber 16. It is to be understood that after penetration by nozzle 30, nozzle 30 may be removed completely from tubular member 28 and insulation blown directly through member 28 if higher volume insulation flow is desired. It is to be noted that the shape of cutting edge 34 promotes the folding of backing layer 24 to provide a more secure connection between member 28 and backing layer 24.

When it is felt that the interior chamber 16 is completely full of insulation such as the stopping of insulation flow, the nozzle 30 is removed and also the elongated member 28 is removed from this particular access opening 44.

At some times, it may be desirable to not employ the nozzle 30 for conducting of insulation and in such an instance, the insulation could be supplied directly through the elongated tubular member 28. It would be necessary to employ some type of instrument to be passed through the tubular member 28 to cut through the portion of the backing layer 24 which is located within the tubular member 28.

With the insulation being transmitted through either the tubular member 28 or the nozzle 30 and deposited within the chamber 16, the presence of the air pressure and the insulation causes physical displacement of the backing layer 24 toward the outer wall 14 and an essential compression of the fiberglass pad 22. The result is a cavity where the pulverized insulation is to be received within each and every chamber 16 within the wall structure 10.

It is to be understood that the foregoing procedure will be repeated for each and every access opening 44. After the pulverized insulation has been supplied within the wall structure 10, the access openings 44 will be closed.

What is claimed is:

1. In combination with an existing wall structure being formed of an inner wall surface and an outer wall surface with there being an enlarged opening therebetween, a layer of insulation located within said enlarged opening, said layer of insulation being composed of a pad of insulative material which is secured to a backing layer of material, said backing layer of material located adjacent said inner wall surface, a tool to facilitate the blowing of additional insulation within said enlarged opening, said tool comprising:

an elongated straight tubular member having an internal chamber to facilitate the passage of blown insulation therethrough, said tubular member having a longitudinal center axis interconnecting an inner end and an outer end, said outer end terminating in a cutting edge, a helical groove formed within said elongated straight tubular member, said helical groove terminating at its outermost end at said cutting edge, an access opening being provided through said outer wall connecting with said internal enlarged opening, said outer end of said tool to be inserted through said access opening and to be moved to cut through said pad of insulation into contact with said backing layer of material, upon rotating of said tool about said longitudinal center axis said cutting edge cuts through said backing layer of material and further rotation of said tool results in said backing layer of material to be located within said helical groove and spaced from said inner wall surface, whereupon the portion of said backing layer of material that is now located within said elongated tubular member is to be cut through to permit conducting of insulation through said elongated tubular member and be deposited between said backing layer of material and said inner wall thereby compressing said pad of insulation thereby permitting a substantial higher quality and greater amount of insulation to be supplied within said enlarged opening.

2. The combination as defined in claim 1 wherein:

a collar slidingly movable on said elongated straight tubular member, said collar including locking means to fixedly position said collar upon said elongated tubular member, whereby with said backing layer of material located within said helical groove and spaced from said inner wall surface the said collar is to be placed in physical contact with the exterior of said outer wall surface and said locking means activated to fix the position of said collar.

3. The combination as defined in claim 1 including:

an elongated nozzle member, said elongated nozzle member to telescopingly cooperate through said elongated tubular member, said elongated nozzle member having a first end and a second end, said first end being adapted to be connected to an insulation blowing machine, said second end including a second cutting edge, said second cutting edge to facilitate cutting through of said portion of said backing layer of material which is located within said elongated tubular member.

4. The combination as defined in claim 2 wherein:

an elongated nozzle member, said elongated nozzle member to telescopingly cooperate through said elongated tubular member, said elongated nozzle member having a first end and a second end, said first end being adapted to be connected to an insulation blowing machine, said second end including a second cutting edge, said second cutting edge to facilitate cutting through and at the same time folding of said portion of said backing layer of material which is located within said elongated tubular member.

5. The method of blowing insulation within an existing wall structure which is formed of an outer wall and an inner wall with an internal chamber located therebetween with there also being a pad of existing insulative material located within said internal chamber, the pad of insulative material including a backing layer of material located adjacent said inner wall, the method comprising steps of:

forming an access opening through said outer wall connecting with said internal chamber;

inserting an elongated tubular member through said access opening with the free end of said tubular member including a helical groove terminating at the outer end in a cutting edge;

moving said tool through said pad of insulation thereby cutting such until the cutting edge comes into contact with said backing layer of material;

rotating the tool about the longitudinal center axis of said elongated tubular member thereby cutting said inside backing layer of material forming a second opening therein;

continuing to rotate said tool causing the backing layer to be moved along said helical groove and be spaced from said inner wall; and supplying pulverized insulation material through said tool to be deposited within said internal chamber between said backing layer material and said inner wall.

* * * * *